US010264946B2

(12) United States Patent
Choi et al.

(10) Patent No.: US 10,264,946 B2
(45) Date of Patent: Apr. 23, 2019

(54) DISHWASHER

(71) Applicant: LG ELECTRONICS INC., Seoul (KR)

(72) Inventors: Kyuhyung Choi, Seoul (KR); Minchul Kim, Seoul (KR); Baekhon Kim, Seoul (KR); Sangsoo Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 57 days.

(21) Appl. No.: 15/303,687

(22) PCT Filed: Jul. 19, 2016

(86) PCT No.: PCT/KR2016/007846
§ 371 (c)(1),
(2) Date: Oct. 12, 2016

(87) PCT Pub. No.: WO2017/014534
PCT Pub. Date: Jan. 26, 2017

(65) Prior Publication Data

US 2017/0181599 A1 Jun. 29, 2017

(30) Foreign Application Priority Data

Jul. 20, 2015 (KR) ..... 10-2015-0102346
Jul. 20, 2015 (KR) ..... 10-2015-0102347
Jan. 5, 2016 (KR) ..... 10-2016-0000981

(51) Int. Cl.
*A47L 15/50* (2006.01)
*A47L 15/42* (2006.01)

(52) U.S. Cl.
CPC ..... *A47L 15/508* (2013.01); *A47L 15/504* (2013.01); *A47L 15/4214* (2013.01); *A47L 15/4217* (2013.01)

(58) Field of Classification Search
CPC ..... A47L 15/50; A47L 15/504; A47L 15/508
(Continued)

(56) References Cited

U.S. PATENT DOCUMENTS 6,431,188 B1 8/2002 Laszczewski, Jr. et al.
2008/0271765 A1* 11/2008 Burrows ..... A47L 15/508 134/172

(Continued)

FOREIGN PATENT DOCUMENTS

CN 101204314 A 6/2008
CN 102008277 A 4/2011

(Continued)

OTHER PUBLICATIONS

Machine translation of KR 20080088123A, dated Oct. 2008. (Year: 2008).*

*Primary Examiner* — Michael E Barr
*Assistant Examiner* — Kevin G Lee
(74) *Attorney, Agent, or Firm* — Dentons US LLP

(57) ABSTRACT

Disclosed is a dishwasher including a tub, a door, a sump, a rack, a spray arm, a water guide including a supply flow-path for movement of the wash water from the sump and a supply port formed in the supply flow-path, a supply unit including a support body for receiving the wash water, a connection pipe extending from the support body to the spray arm, and an spray arm coupler, and a connection member including a coupling body coupled to the water guide and the support body, and a through-hole formed in the coupling body. The supply unit includes a rearwardly protruding insertion portion, and the connection member includes protrusions spaced apart from each other to define an insertion space for the protruding insertion portion, so that the supply unit is coupled to the water guide as the protruding insertion portion is inserted into one of the insertion space.

28 Claims, 13 Drawing Sheets

(58) Field of Classification Search
USPC ..... 134/145, 151, 56 D
See application file for complete search history.

(56) References Cited

U.S. PATENT DOCUMENTS

| | | | | |
|---|---|---|---|---|
| 2009/0090400 | A1* | 4/2009 | Burrows | A47L 15/508 134/178 |
| 2011/0155190 | A1 | 6/2011 | Oblinger et al. | |
| 2012/0097198 | A1* | 4/2012 | Schmidt | A47L 15/508 134/144 |
| 2012/0285491 | A1 | 11/2012 | Blanchard et al. | |
| 2013/0068265 | A1 | 3/2013 | Gnadinger et al. | |
| 2014/0373883 | A1 | 12/2014 | Haft et al. | |

FOREIGN PATENT DOCUMENTS

| | | | | |
|---|---|---|---|---|
| CN | 102458214 | A | 5/2012 | |
| CN | 202875277 | U | 4/2013 | |
| CN | 203447254 | U | 2/2014 | |
| DE | 19926962 | A1 | 12/1999 | |
| DE | 102007041307 | A1 | 3/2009 | |
| EP | 1935322 | A2 * | 6/2008 | A47L 15/508 |
| JP | 2014-183892 | A | 10/2014 | |
| KR | 10-2007-0078129 | A | 7/2007 | |
| KR | 10-2008-0088123 | A | 10/2008 | |
| KR | 101301495 | B1 | 8/2013 | |
| KR | 101634173 | B1 * | 6/2016 | |
| WO | 2010-149343 | A1 | 12/2010 | |

* cited by examiner

[Fig. 1]
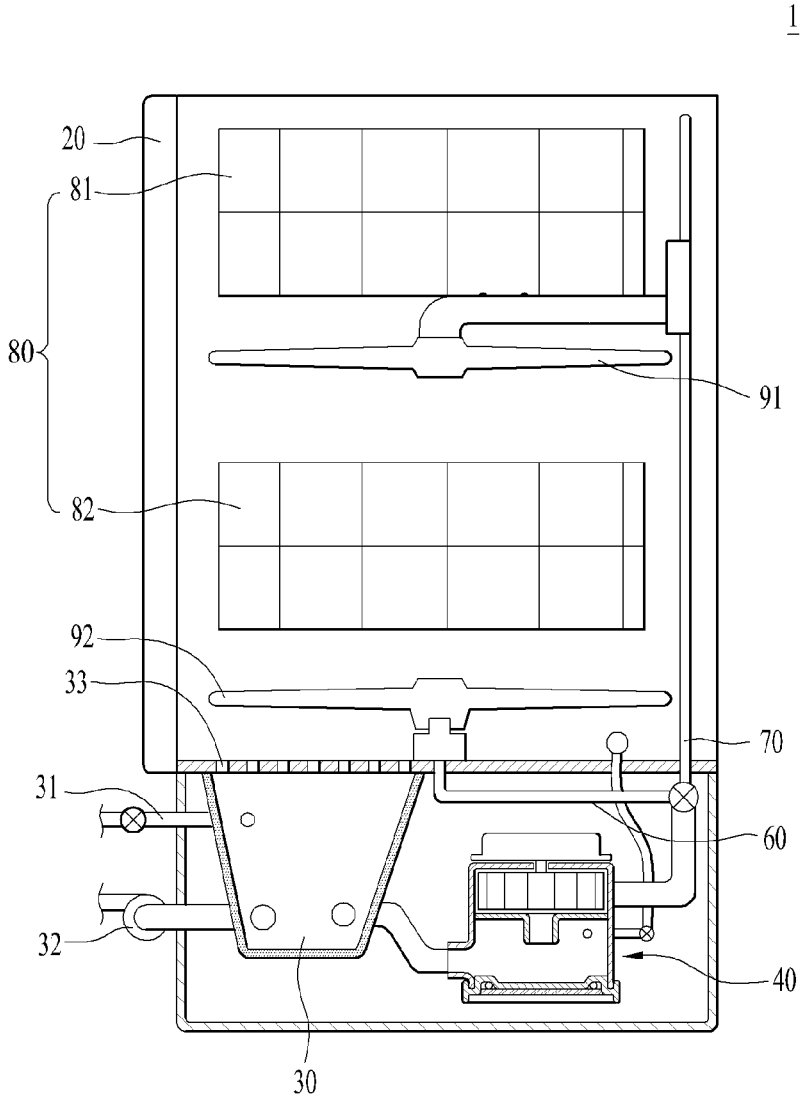

[Fig. 2]
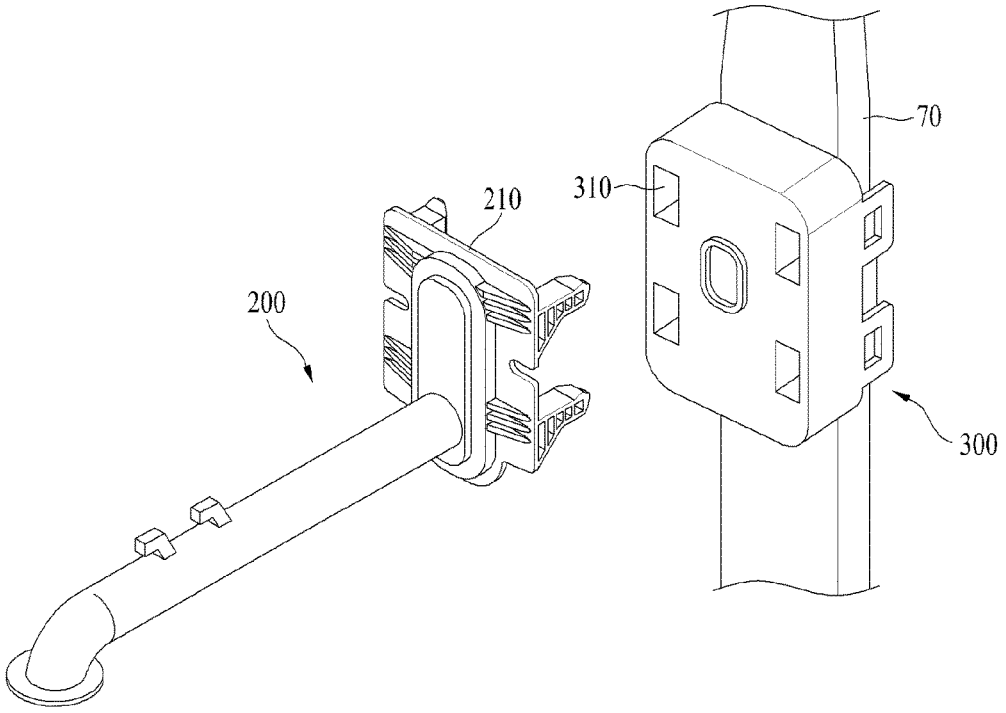

[Fig. 3]
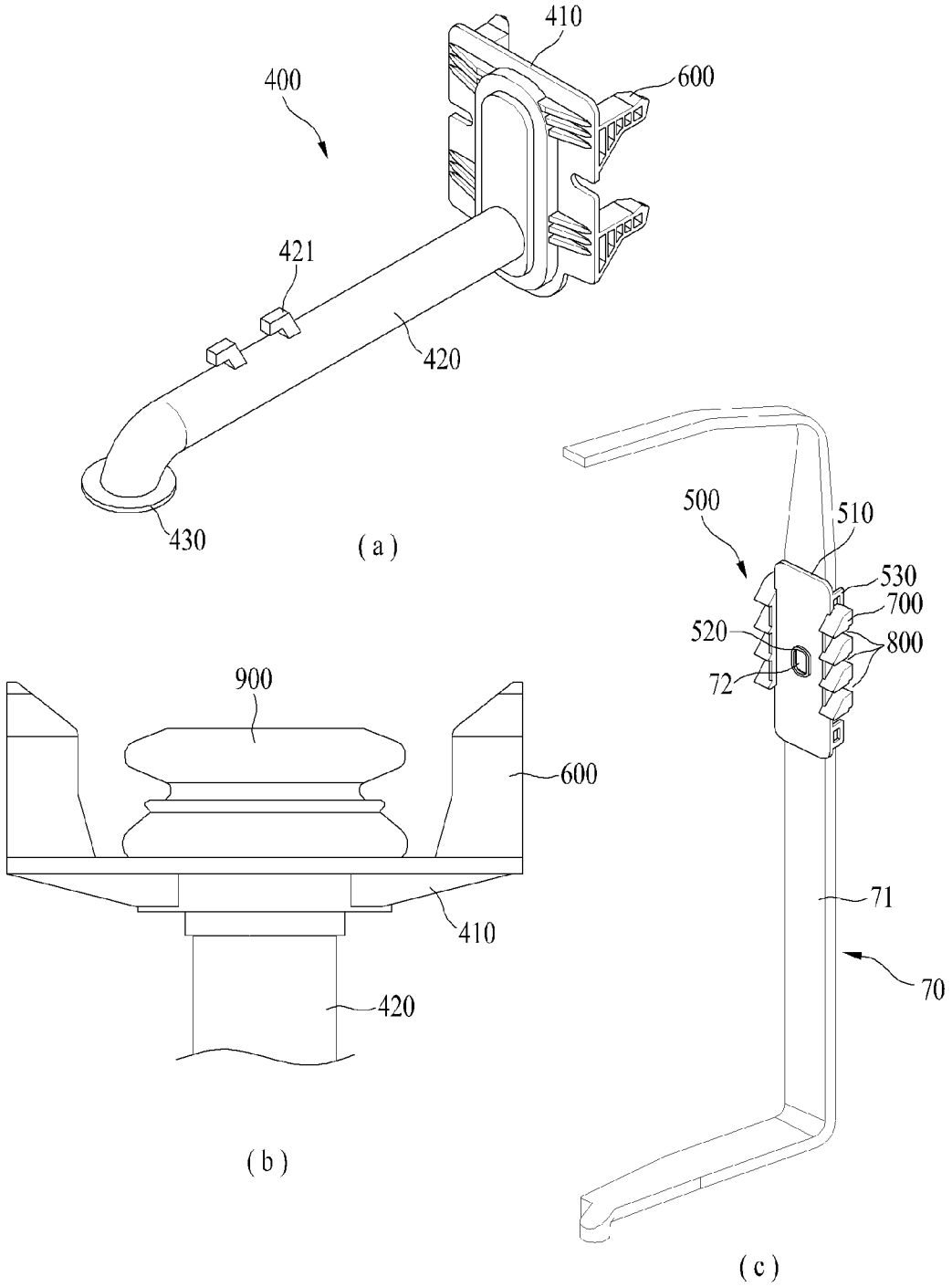

[Fig. 4]
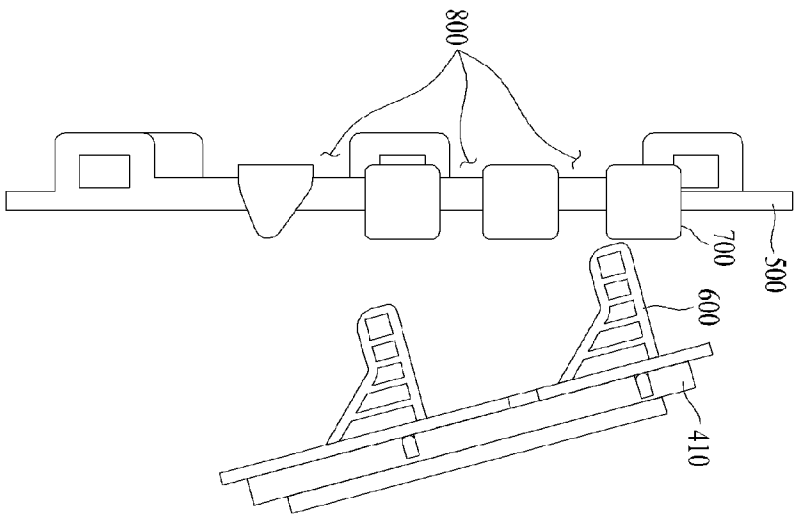
(a)
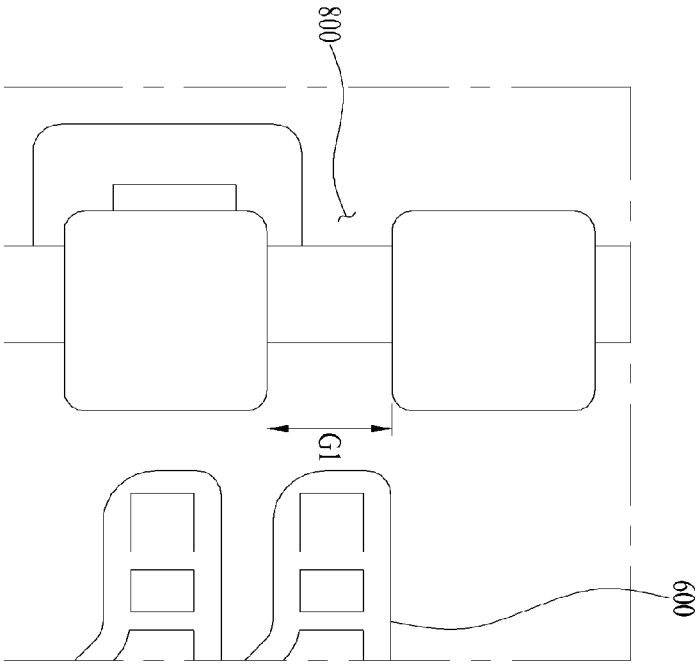
(b)

[Fig. 5]
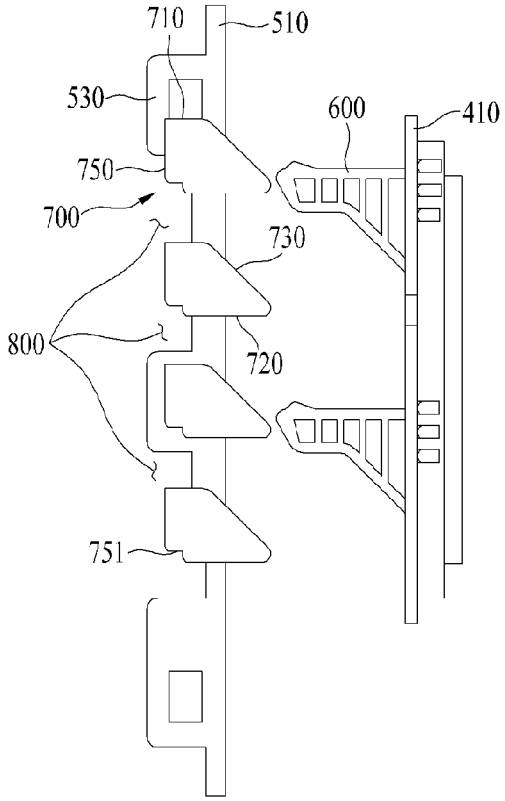
(a)
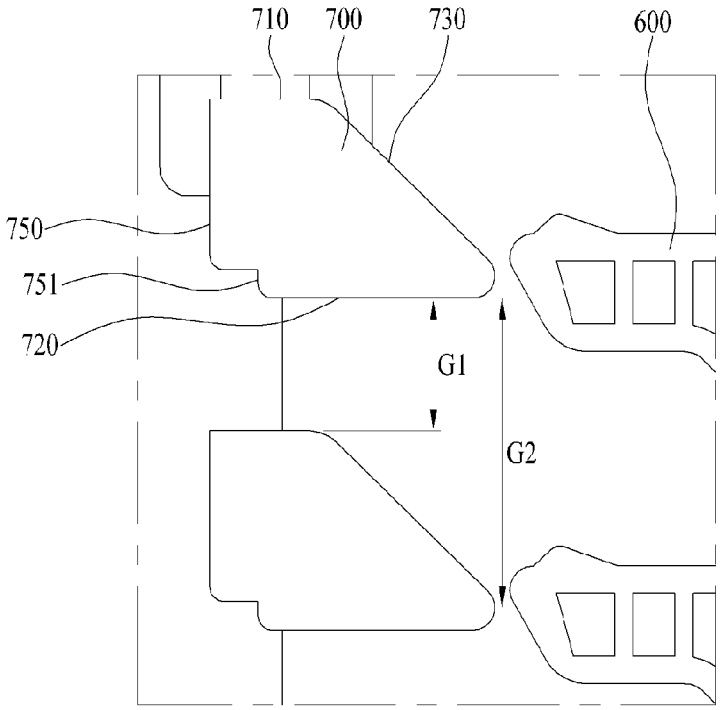
(b)

[Fig. 6]
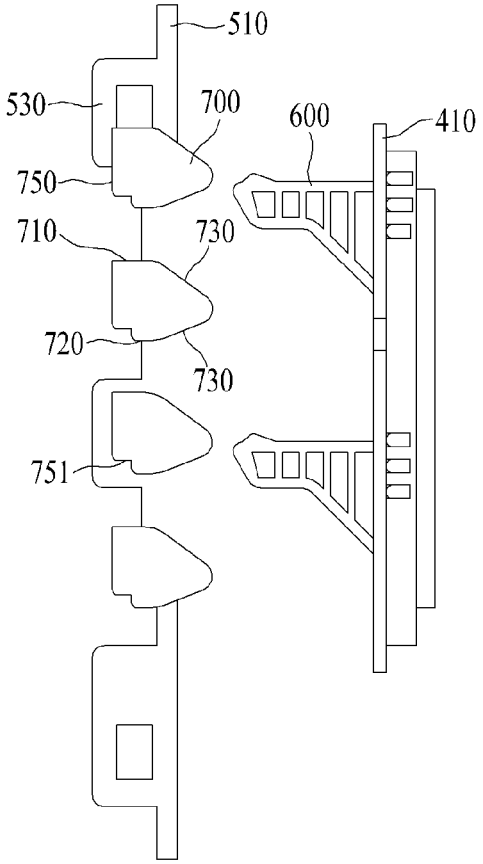

[Fig. 7]
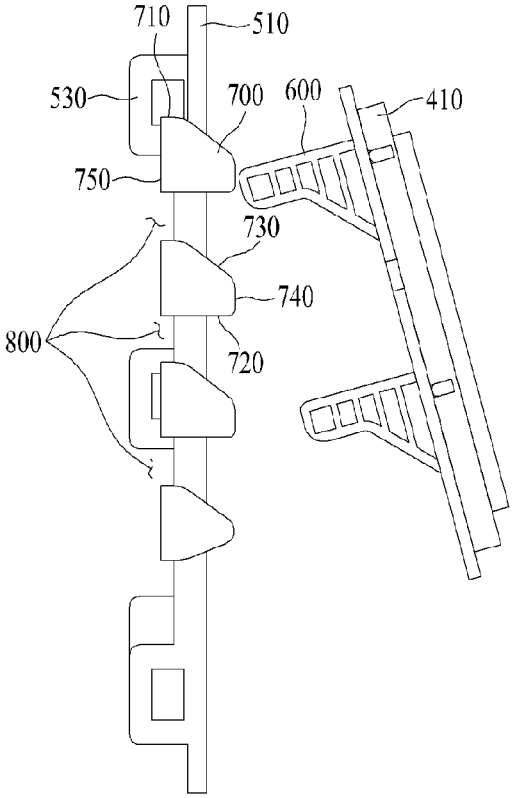
(a)
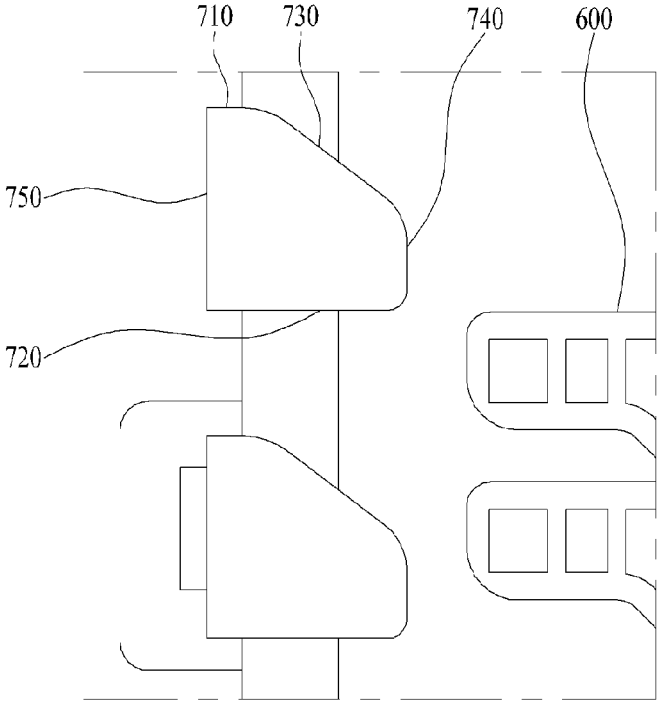
(b)

[Fig. 8]
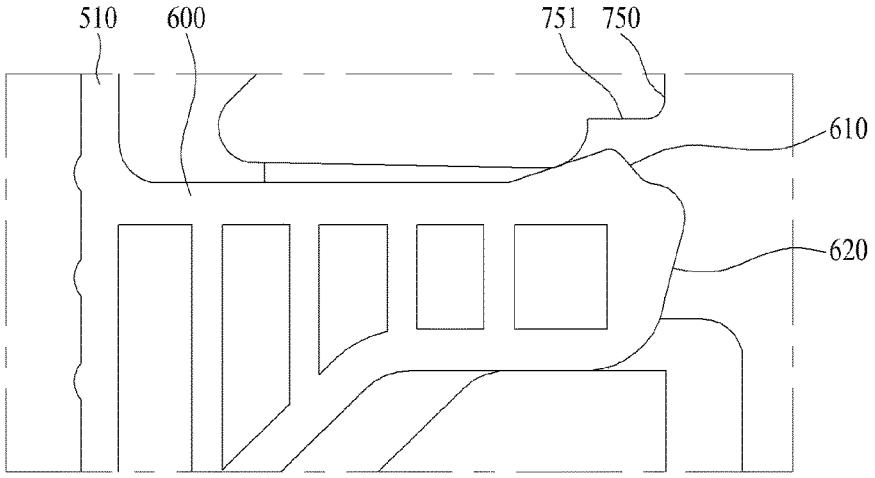
[Fig. 9]
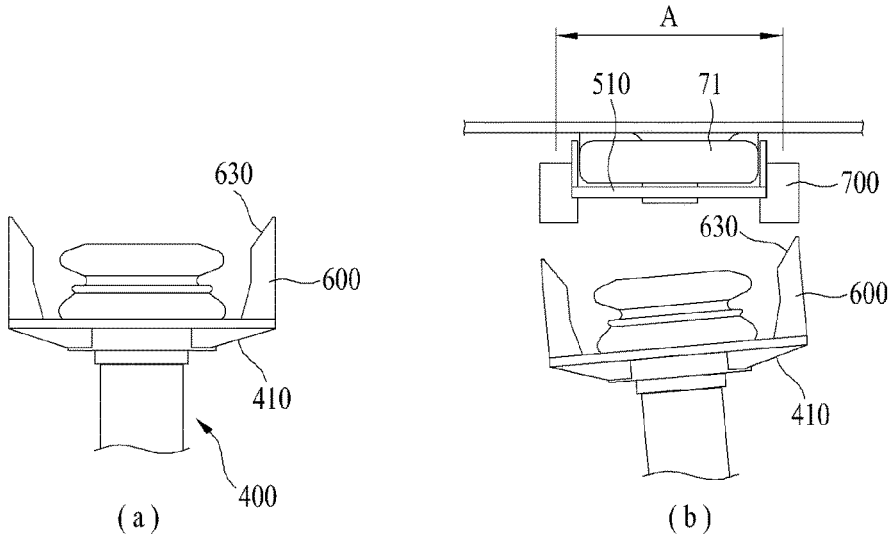
[Fig. 10]
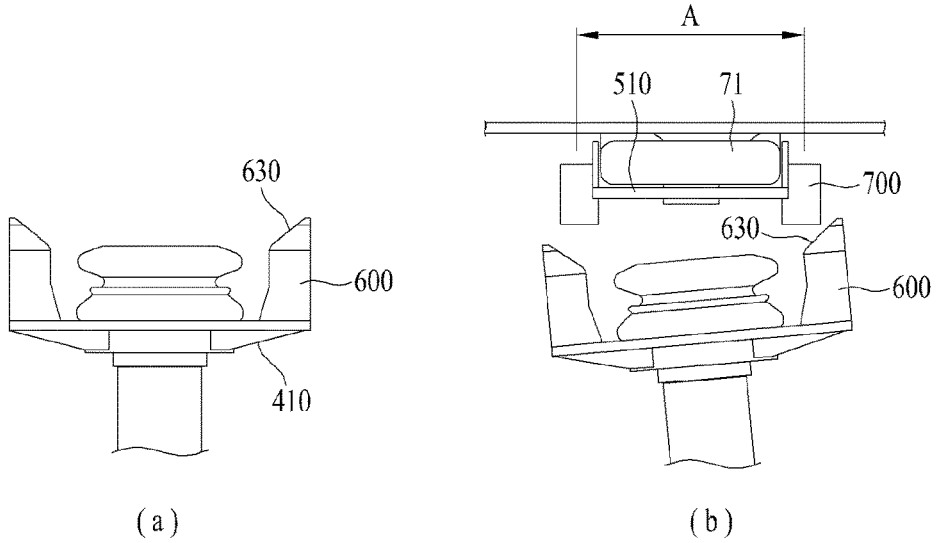

[Fig. 11]
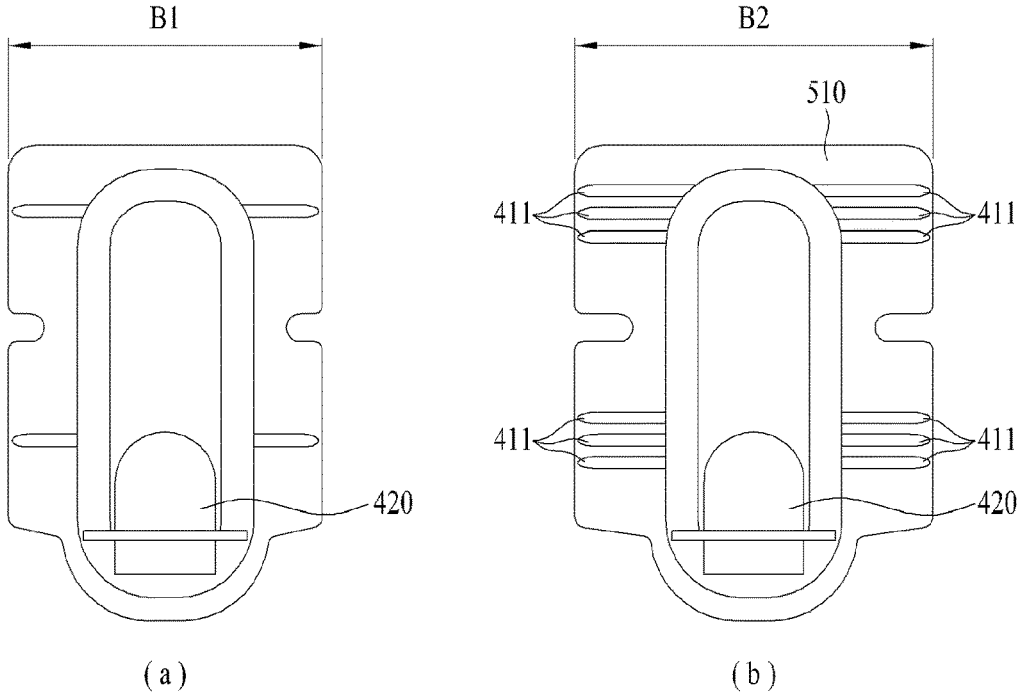
[Fig. 12]
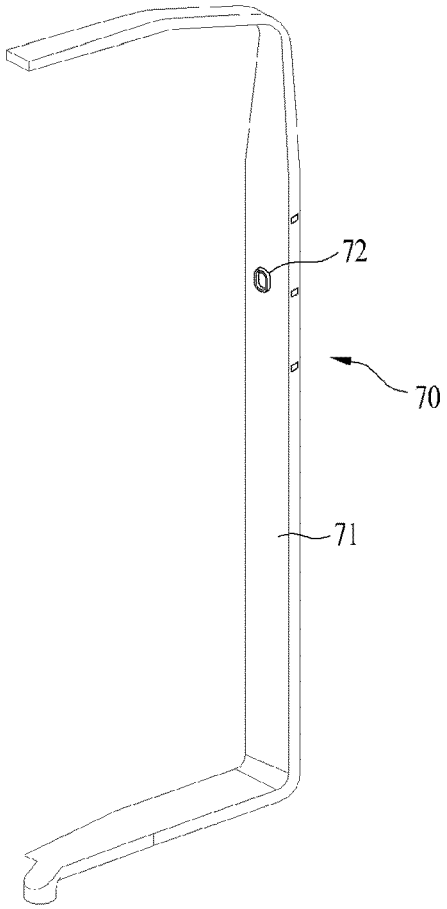

[Fig. 13]
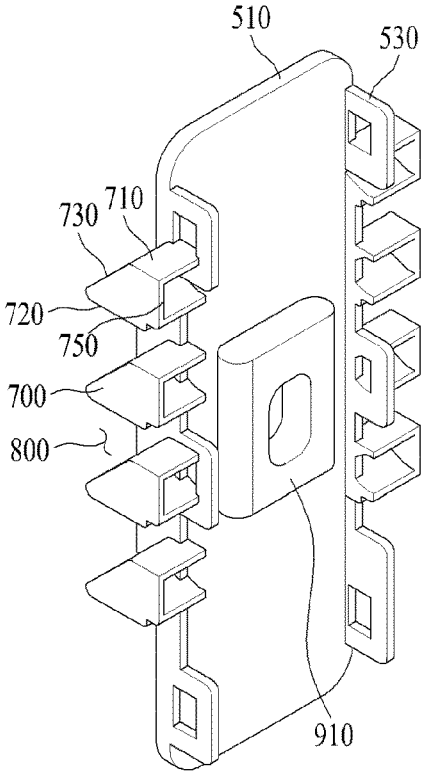
[Fig. 14]
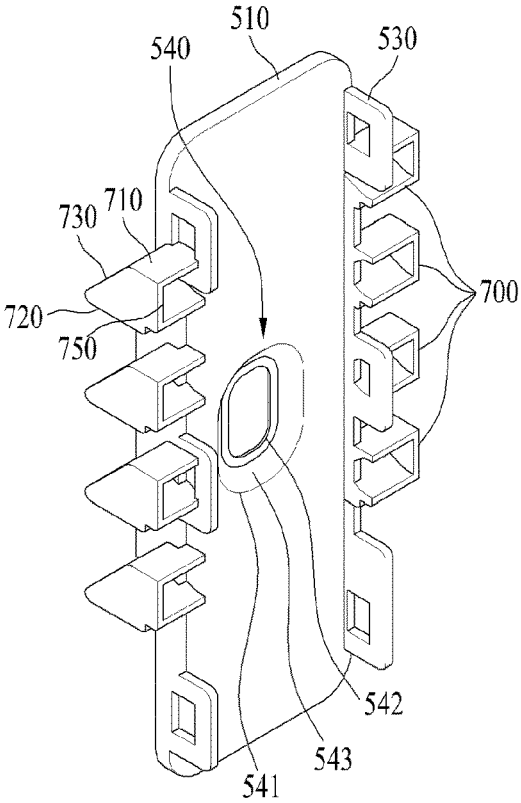

[Fig. 15]
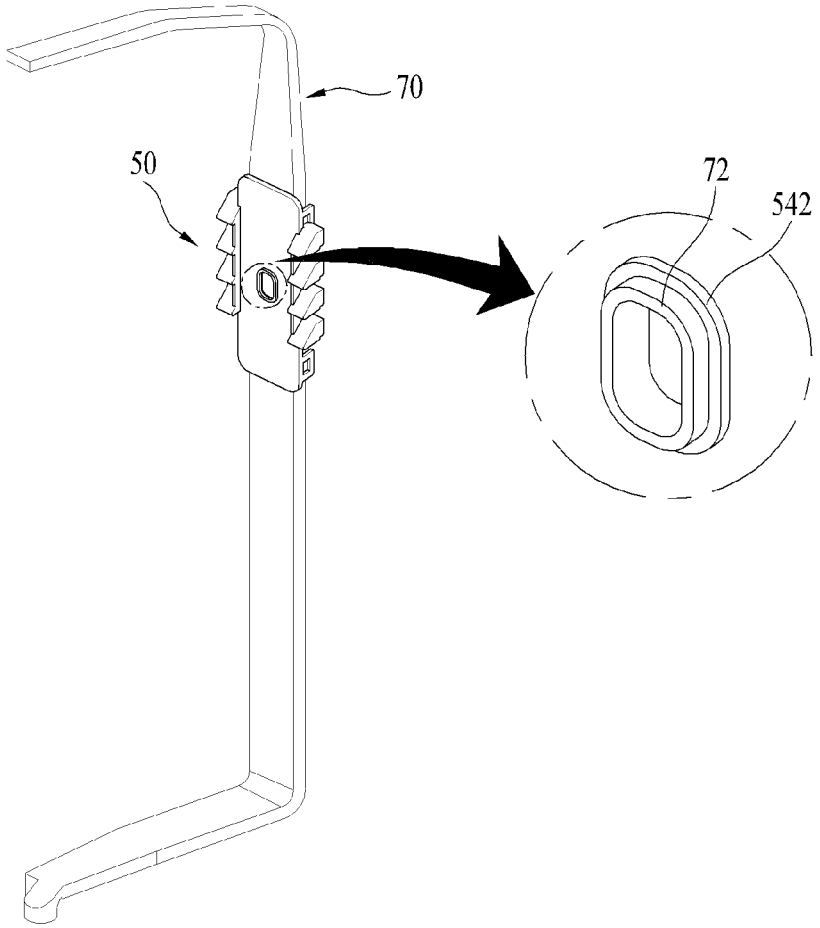

[Fig. 16]
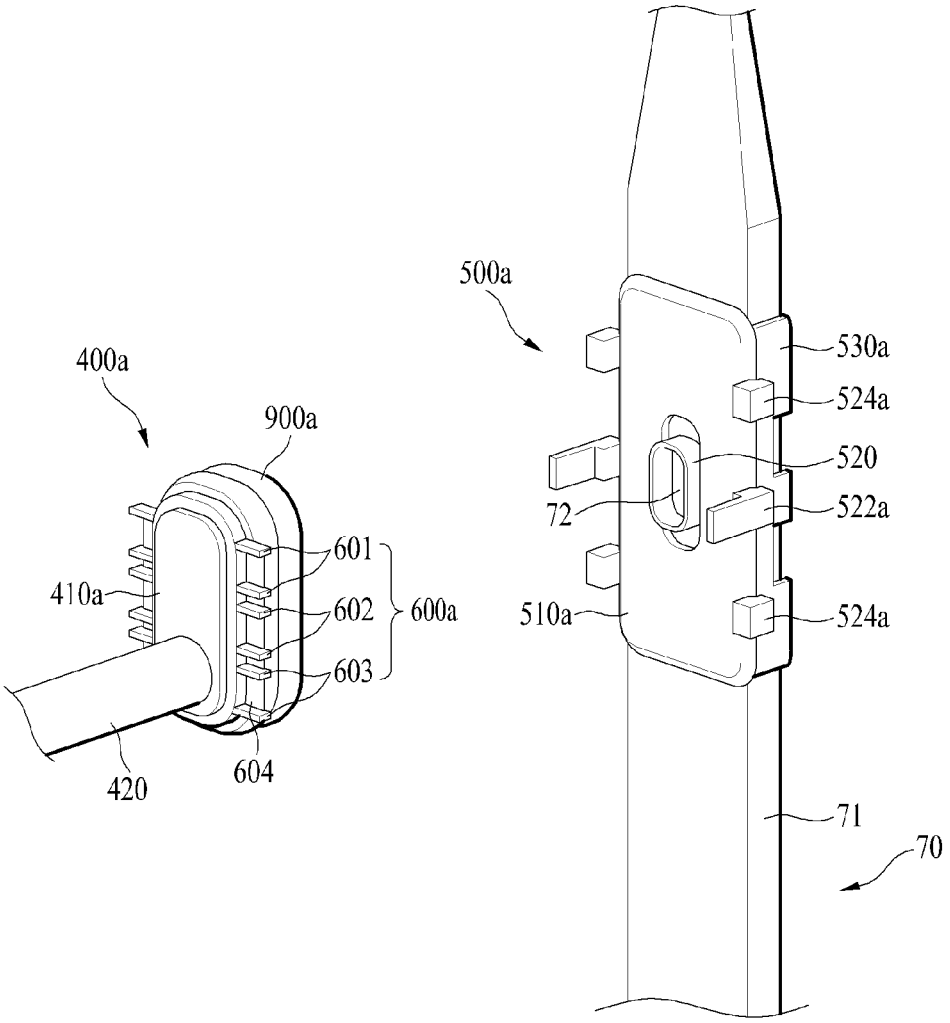
[Fig. 17]
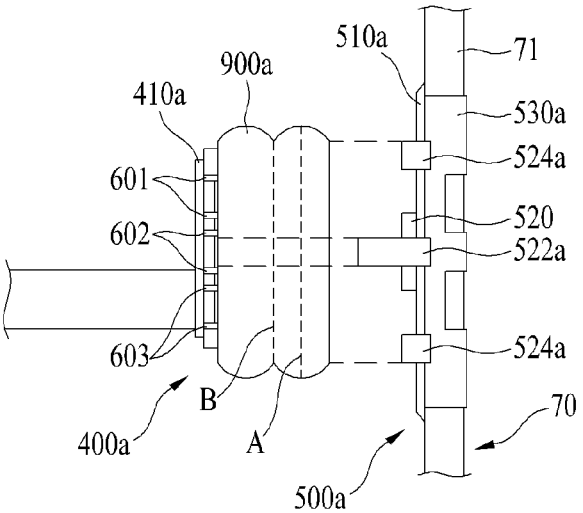

[Fig. 18]
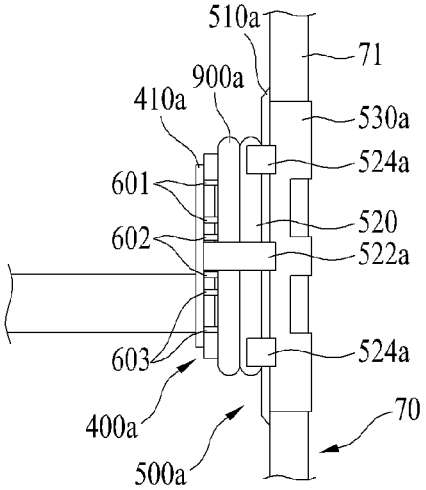
[Fig. 19]
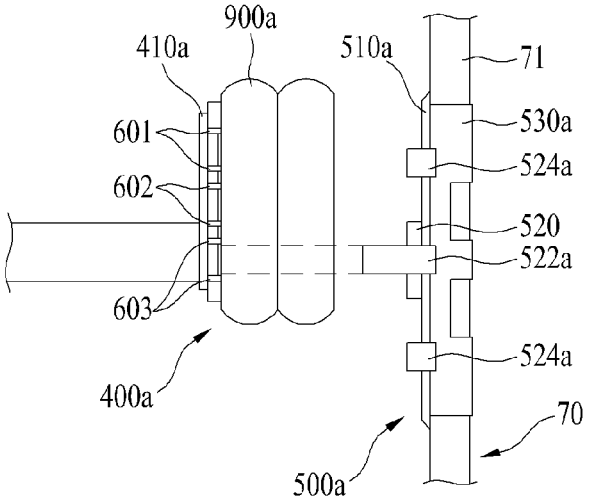
[Fig. 20]
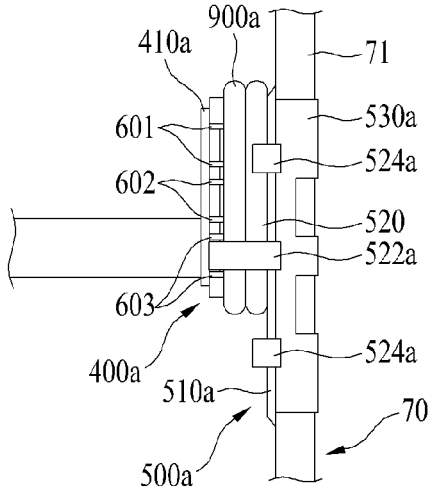

DISHWASHER

This application is a National Stage Application of International Application No. PCT/KR2016/007846, filed on Jul. 19, 2016, which claims the benefit of Korean Patent Application No. 10-2015-0102346, filed on Jul. 20, 2015, Korean Patent Application No. 10-2015-0102347, filed on Jul. 20, 2015 and Korean Patent Application No. 10-2016-0000981, filed on Jan. 5, 2016, all of which are hereby incorporated by reference in their entirety for all purposes as if fully set forth herein.

TECHNICAL FIELD

The present invention relates to a dishwasher, and more particularly, to a dishwasher having an improved fastening structure between a water guide, which supplies wash water to the dishwasher, and a supply unit, which is fastened to the water guide.

BACKGROUND ART

A dishwasher is a home appliance that removes impurities remaining on objects to be washed by spraying wash water to the objects to be washed. The dishwasher ac-commodates the objects to be washed (e.g. dishes) in a washing space, and thereafter removes scraps remaining on the objects to be washed using wash water. The dishwasher may perform drying of the objects to be washed if desired.

In other words, the dishwasher is a home appliance that washes food residue adhered to the surface of dishes using high-pressure wash water sprayed from spray nozzles. The dishwasher is provided with, for example, a tub, which defines the washing space, and a sump, which is mounted to the lower surface of the tub for storing wash water therein. The dishwasher performs a washing operation, a rinsing operation, and a drying operation in sequence.

Meanwhile, when the dishwasher has a drying function, the dishwasher is provided with a dryer, which supplies heated air to the inside of the tub so as to remove moisture remaining on the dishes. The dryer may include, for example, a heater to heat air, and a blowing fan to blow the air heated by the heater. In addition, in order to dehumidify humid air during drying, zeolite or a heat pump system is generally used.

FIG. 1 is a schematic view illustrating the internal configuration of a conventional dishwasher.

Referring to FIG. 1, the conventional dishwasher 1 generally includes a tub 10 providing a washing space, a door 20 provided on the front of the tub 10 for opening or closing the washing space, a rack 80 provided in the tub 10 for accommodating an object to be washed, an upper spray arm 91 and a lower spray arm 92 for spraying wash water to the rack 80, a sump 30 for storing wash water, and a pump 40 for supplying the wash water stored in the sump 30 to the spray arms 91 and 92.

The rack 80 may be comprised of an upper rack 81 and a lower rack 82. The upper rack 81 and the lower rack 82 may be provided with support rails (not illustrated), and the tub 10 may be provided on the inner circumferential surface thereof with support rail guides (not illustrated), so that the upper rack 81 and the lower rack 82 may be pulled forward from the tub 10.

The wash water, stored in the sump 30, is discharged through the pump 40. The discharged wash water is supplied to a lower flow-path 60, which transfers the wash water to the lower rack 82, and is also supplied to a water guide 70, which transfers the wash water to the upper rack 81. The wash water, supplied to the water guide 70, passes through a supply unit 200 and is transferred to the upper spray arm 91.

Meanwhile, in the conventional dishwasher 1, the upper rack 81 may be separably provided at different heights inside the tub 10, which may allow a user to appropriately utilize the space inside the tub 10 as needed.

In addition, the supply unit 200 may be separably coupled to the water guide 70 at different heights as the upper rack 81 is moved, in order to ensure the efficient washing of dishes accommodated in the upper rack 81.

FIG. 2 is a perspective view illustrating the supply unit 200 and the water guide 70 of the conventional dishwasher 1. Referring to FIG. 2, the supply unit 200 of the conventional dishwasher 1 includes a connection member 300, which is coupled to the water guide 70 in order to allow the supply unit 200 to be separably coupled to the water guide 70.

The supply unit 200 of the conventional dishwasher 1 is provided with an insertion portion 210 so as to be coupled to the connection member 300, and the connection member 300 has a plurality of insertion holes 310, into which the protruding insertion portion 210 may be inserted. The insertion holes 310 may be formed at different heights in order to allow the supply unit 200 to be separably coupled to the water guide 70 at different heights.

Meanwhile, the conventional dishwasher 1 has a problem whereby the protruding insertion portion 210 may not be inserted into the insertion hole 310 when the supply unit 200 is tilted vertically or horizontally relative to the water guide 70 upon insertion.

In particular, when the supply unit 200 is coupled to the upper rack 81, the user may fail to smoothly insert the protruding insertion portion 210 of the supply unit 200 into the insertion hole 310 because the upper rack 81 is tilted upward or downward. In this case, even if the protruding insertion portion 210 of the supply unit 200 is completely inserted into the insertion hole 310, the supply unit 200 may not be fixed to the insertion hole 310.

In addition, the conventional dishwasher 1 has a problem in which it has no means capable of preventing the user from inserting the supply unit 200 into an undesired insertion hole 310, in which case the supply unit 200 may not be inserted into the correct position.

Moreover, because the leakage of wash water may occur between the water guide 70 and the connection member 300 when the supply unit 200 is not inserted into the insertion hole 310 at the correct position, the conventional dishwasher 1 may suffer from deterioration in washing efficiency attributable to a reduction in the pressure and flow rate of wash water to be supplied to the upper spray arm 91.

In addition, the conventional dishwasher 1 includes a sealing member (not illustrated), which is formed of a rubber material and takes the form of a bellows having prescribed elasticity, in order to prevent the leakage of wash water from between the supply unit 200 and the water guide 70 when the supply unit 200 is installed to the water guide 70.

However, the conventional sealing member, which takes the form of a rubber bellows, may cause abnormal noises due to the interference of creases forming the bellows when the supply unit 200 and the water guide 70 are coupled to each other.

In addition, the position at which the supply unit 200 and the water guide 70 are coupled to each other may be changed depending on the position at which the upper rack 81 is mounted, and wash water may leak from between the supply unit 200 and the water guide 70 depending on the installed state of the sealing member.

DISCLOSURE OF INVENTION

Technical Problem

Therefore, the present invention has been made in view of the above problems, and one object of the present invention is to provide a dishwasher in which a supply unit may be smoothly inserted into a water guide even if it approaches, in an upwardly or downwardly tilted state, the water guide.

In addition, another object of the present invention is to provide a dishwasher in which a supply unit may be smoothly inserted into a water guide even if it approaches, in a leftwardly or rightwardly tilted state, the water guide.

In addition, another object of the present invention is to provide a dishwasher, which may guide a user to insert a supply unit at the correct position by preventing the insertion of the supply unit when the supply unit is directed to an incorrect position.

In addition, another object of the present invention is to provide a dishwasher, which may prevent a supply unit fastened to a water guide from being easily separated, thereby increasing the stability thereof.

In addition, another object of the present invention is to provide a dishwasher, which may prevent wash water from leaking from between a water guide and a connection member, thereby increasing washing efficiency.

In addition, another object of the present invention is to provide a dishwasher, which may improve leakage prevention effects owing to a sealing member having an improved structure.

In addition, a further object of the present invention is to provide a dishwasher, which may reduce the deformation of a sealing member and the generation of noise.

Solution to Problem

In accordance with an aspect of the present invention, the above and other objects can be accomplished by the provision of a dishwasher including a tub providing a washing space, a door provided on a front of the tub for opening or closing the washing space, a sump provided under the tub for storing wash water, a rack provided so as to be pulled from the tub for accommodating an object to be washed, a spray arm for spraying wash water to the object to be washed, a water guide including a supply flow-path for communicating with the sump, the supply flow-path being provided inside the tub for providing a flow-path for movement of the wash water from an inside of the sump, and a supply port formed in one surface of the supply flow-path for supplying the wash water, a supply unit including a support body provided with a communication hole for communicating with the supply port in order to receive the wash water, a connection pipe extending from the support body for transferring the wash water to the spray arm, and an spray arm coupler provided on an end of the connection pipe so as to be coupled to the spray arm, and a connection member including a coupling body having one surface coupled to the water guide and a remaining surface coupled to the support body, and a through-hole formed in the coupling body so as to communicate with the supply port, wherein the supply unit further includes at least one insertion portion protruding rearward from opposite side surfaces of the support body, and wherein the connection member includes a plurality of protrusions protruding from opposite side surfaces of the coupling body and spaced apart from each other by a distance that is equal to a thickness of the protruding insertion portion so as to define at least two insertion spaces for insertion of the protruding insertion portion, so that the supply unit is coupled to the water guide as the protruding insertion portion is inserted into one of the insertion spaces.

The protrusions may include at least three pairs of protrusions provided along the opposite side surfaces of the coupling body so as to define at least two pairs of insertion spaces, and the supply unit may be coupled to the water guide at any of different heights as the protruding insertion portion is inserted into and coupled to one of the insertion spaces.

Each of the protrusions may include a forwardly extending first support surface, a slope inclined forward from an end of the first support surface, and a second support surface extending rearward from an end of the slope, and the slope may guide the protruding insertion portion so as to be inserted into one of the insertion spaces even if the protruding insertion portion is inserted, in an upwardly or downwardly tilted state, into the insertion space.

The first support surface may have a length shorter than a length of the second support surface so that the slope is inclined upward.

The first support surface may have a length longer than a length of the second support surface so that the slope is inclined downward.

The protrusion may include a retaining surface connecting the first support surface and the second support surface to each other, the protruding insertion portion may include a raised retaining portion on an upper surface and/or a lower surface thereof, and the raised retaining portion may be fixed to the retaining surface when the protruding insertion portion is completely inserted into the insertion space.

Each of the protrusions may include a forwardly extending first support surface, a slope inclined forward from an end of the first support surface, a blocking surface extending from an end of the slope so as to be parallel to one surface of the coupling body, and a second support surface extending rearward from an end of the blocking surface, and the blocking surface may prevent the protruding insertion portion from being inserted into the insertion space when the protruding insertion portion is inserted to an incorrect position.

Each of the protrusions may include a forwardly extending first support surface, a first slope inclined forward from an end of the first support surface, a second slope inclined rearward from an end of the first slope, and the second support surface extending rearward from the second slope, and the first slope and the second slope may guide the protrusion insertion portion so as to be inserted into one of the insertion spaces when the protruding insertion portion is inserted in an upwardly or downwardly tilted state.

The protruding insertion portion may be provided in a plural number so as to be inserted into at least two insertion spaces among the insertion spaces.

The protruding insertion portion may include an insertion slope provided on an end thereof so as to be inclined relative to a height direction.

The protruding insertion portion may include a side slope provided on an end thereof so as to be inclined toward a center of the support body so that the protruding insertion portion is guided into the insertion space even if the support body is inserted, in a leftwardly or rightwardly tilted state, into the coupling body.

The support body may have a width greater than a width of the coupling body, and the at least one protruding insertion portion may include a pair of protruding insertion portions provided on the opposite side surfaces of the support body, and a distance between the protruding insertion portions is equal to the width of the coupling body.

The support body may include a plurality of protruding reinforcement ribs on one surface thereof, provided with the connection pipe, so as to extend in a left-to-right direction, and the reinforcement ribs may be spaced apart from each other by a constant distance in a height direction of the support body.

The reinforcement ribs may be provided on a portion of the surface of the support body that corresponds to a location of the protruding insertion portion.

The dishwasher may further include a sealing member for sealing a gap between the support body and the coupling body, and the protruding insertion portion on the support body may have a length greater than a thickness of the sealing member.

The sealing member may have a height and width greater than a height and a width of the supply port.

The sealing member may be flexible in a movement direction of the supply unit.

The dishwasher may further include a second sealing member provided between the coupling body and the water guide so as to come into contact with an outer circumference of the through-hole in the coupling body and an outer circumference of the support port, thereby preventing leakage of wash water from between the coupling body and the water guide.

The connection member may include a sealing unit provided on an inner circumference of the through-hole in the coupling body for preventing leakage of wash water from between the coupling body and the water guide.

The supply port may protrude from one surface of the supply flow-path, the sealing unit may include a sealing body provided on the inner circumference of the through-hole, and an introduction port provided on an inner circumference of the sealing body and having a diameter smaller than a diameter of the supply port, the sealing body and the introduction port may be formed as an elastic member, and the introduction port may have a shape corresponding to a shape of the supply port so that an inner circumference of the introduction port comes into close contact with an outer circumference of the supply port when the supply port is inserted into the introduction port, thereby preventing leakage of wash water from between the supply port and the coupling body.

The introduction port may have a thickness smaller than a thickness of the sealing body.

The sealing body may have the same thickness as the coupling body, and may include a sloped portion, a thickness of which is gradually reduced from a center of the sealing body to the introduction port, so as to guide the supply port to be inserted into the introduction port.

The sealing unit may be integrally formed with the coupling body via injection molding.

The dishwasher may further include a guide provided on the connection member for assisting a wash water supply opening in being positioned inside the sealing member when the sealing member is compressed, and a connector provided on the support body and connected to the guide when the sealing member is compressed.

The connector may include a first connector protruding from the support body, a second connector protruding from the support body and spaced apart from the first connector by a prescribed distance, and a third connector protruding from the support body and spaced apart from the second connector by a prescribed distance, and the guide may be coupled to one of the first connector, the second connector, and the third connector.

The dishwasher may further include a body defining a main body of the connection member, a stopper provided on the body for limiting a compressible distance of the sealing member, and an extension provided on the support body so as to come into contact with the stopper when the sealing member is compressed.

The stopper may protrude from the body toward the sealing member.

The stopper may be provided in a plural number on the body, and the plurality of stoppers is symmetrically provided on left and right sides of the body.

Advantageous Effects of Invention

A dishwasher according to the present invention has the effect of allowing a supply unit to be smoothly inserted into a water guide even if it approaches, in an upwardly or downwardly tilted state, the water guide.

The dishwasher according to the present invention has the effect of allowing the supply unit to be smoothly inserted into the water guide even if it approaches, in a leftwardly or rightwardly tilted state, the water guide.

The dishwasher according to the present invention has the effect of guiding a user to insert the supply unit at the correct position by preventing the insertion of the supply unit when the supply unit is directed to an incorrect position.

The dishwasher according to the present invention has the effect of preventing the supply unit fastened to the water guide from being easily separated, thereby increasing the stability thereof.

The dishwasher according to the present invention has the effect of preventing wash water from leaking from between the water guide and a connection member, thereby increasing washing efficiency.

The dishwasher according to the present invention has the effect of preventing the leakage of wash water by improving the structures of a sealing member and a gasket.

The dishwasher according to the present invention has the effect of ensuring easier coupling and height adjustment of a spray arm by improving the coupling structure between the spray arm and the water guide.

The dishwasher according to the present invention has the effect of reducing the generation of noise owing to a sealing unit, which may be compressed in the front-to-rear direction.

The dishwasher according to the present invention has the effect of reducing the risk of deformation of the sealing unit by adjusting the degree by which the sealing unit is compressed.

The dishwasher according to the present invention has the effect of maximizing the utility of a washing space by adjusting the height of the spray arm.

BRIEF DESCRIPTION OF DRAWINGS

The accompanying drawings, which are included to provide a further understanding of the invention, illustrate embodiments of the invention and together with the description serve to explain the principle of the invention.

In the drawings:

FIG. 1 is a view illustrating the configuration of a conventional dishwasher;

FIG. 2 is a view illustrating the configuration of a connection member, which connects a supply unit and a water guide to each other, in the conventional dishwasher;

FIG. 3 is a view illustrating the configuration of a supply unit, a connection member, and a water guide according to one embodiment of the present invention;

FIGS. 4 to 7 are views illustrating embodiments of protrusions of the connection member according to the present invention;

FIG. 8 is a view illustrating the shape of an insertion portion of the supply unit according to one embodiment of the present invention;

FIGS. 9 to 11 are views illustrating the shapes of the connection member and the protruding insertion portion according to one embodiment of the present invention;

FIGS. 12 to 15 are views illustrating the shapes of the connection member and the water guide according to one embodiment of the present invention;

FIG. 16 is a view illustrating a supply unit and a connection member according to another embodiment of the present invention in an enlarged scale;

FIGS. 17 and 18 are views illustrating the coupled state of the supply unit and the connection member according to another embodiment of the present invention; and FIGS. 19 and 20 are views illustrating a different coupled state of the supply unit and the connection member according to another embodiment of the present invention.

BEST MODE FOR CARRYING OUT THE INVENTION

Hereinafter, exemplary embodiments of the present invention will be described in detail with reference to the accompanying drawings.

So long as being not specially defined, all terms in the context of describing the invention may be commonly understood by those skilled in the art to have the same meaning as the general meaning, or may be dedicatedly defined in the specification when having a specific meaning conflicting with the general meaning thereof.

Meanwhile, the configuration of an apparatus or a control method of the apparatus, which will be described below, is merely given to describe the embodiments of the present invention, without being intended to limit the scope of the present invention. The same reference numerals used throughout the specification refer to the same constituent elements.

The structure of a dishwasher according to the present invention will be described below with reference to FIG. 1.

The dishwasher 1 according to the present invention generally includes a cabinet defining the external appearance of the dishwasher 1, the tub 10 providing a washing space, the door 20 provided on the front of the tub 10 for opening or closing the washing space, the sump 30 provided under the tub 10 for storing wash water, the rack 80 provided so as to be pulled from the tub 10 for accommodating an object to be washed, the spray arm 90 for spraying wash water to the object to be washed, and the pump 40 for supplying the wash water from the sump 30 to the spray arm 90.

The rack 80 includes a lower rack 82 provided in a lower region of the tub 10 and an upper rack 81 spaced apart from the lower rack 82. The spray arm 90 includes a lower spray arm 92 for spraying wash water to the lower rack 82 and an upper spray arm 91 for spraying wash water to the upper rack 81. Each of the upper spray arm 91 and the lower spray arm 92 may be rotatably installed, and may be provided with a plurality of spray nozzles (not illustrated) for spraying wash water toward the object to be washed, i.e. dishes.

The sump 30 may receive and store wash water supplied through a water supply pipe 31, and may discharge the wash water through a water drain pipe 32. In addition, a sump cover 33, provided on the top of the sump 30, is provided with a drain hole so that the wash water supplied to the tub 10 may again be collected and stored in the sump 30. The pump 40 supplies the wash water stored in the sump 30 to the lower flow-path 60, which supplies the wash water to the lower spray arm 92, and the water guide 70, which supplies the wash water to the upper spray arm 91.

The water guide 70 and a connection member fastened to the water guide 70 will be described below with reference to FIG. 3.

Referring to FIG. 3(*c*), the water guide 70 includes a supply flow-path 71, which communicates with the sump 30 through the connection flow-path 60 and is provided inside the tub 10 for providing a flow-path for the movement of wash water from the inside of the sump 30, and a supply port 72, which protrudes from the supply flow-path 71 for discharging the wash water.

Referring to FIG. 3(*c*), a supply unit 400 may be coupled to the water guide 70 so as to communicate with the supply port 72 in order to receive wash water. The supply unit 400 may be comprised of a support body 410, which is provided with a communication hole (not illustrated) for communicating with the supply port 72 in order to receive wash water, a connection pipe 420 for transferring wash water from the support body 410 to the spray arm 90, and an spray arm coupler 430 provided on the end of the connection pipe 420 so as to be coupled to the spray arm 90.

The connection pipe 420 may be provided on the top thereof with a hook 421, which may be fastened to the bottom of the upper rack 81. As such, the supply unit 400 may be coupled to both the upper rack 81 and the water guide 70. In addition, the upper spray arm 91 may be rotatably coupled to the spray arm coupler 430 (see FIG. 1).

Referring to FIG. 3(*b*), the support body 400 may be provided with a protruding insertion portion 600, which protrudes from one surface of the support body 410 opposite to the connection pipe 420, the communication hole (not illustrated) for receiving wash water from the supply port 72 and transferring the wash water to the connection pipe 420, and a sealing member 900 coupled to the outer circumference of the communication hole (not illustrated) for preventing the leakage of wash water from between the support body 410 and the water guide 70 when the support body 410 is fastened to the water guide 70.

The sealing member 900 may be an elastic member, and may take the form of a dualstage hose provided with a portion having a reduced cross section at an intermediate height thereof. Accordingly, even if a gap is present between the support body 410 and the water guide 70, the sealing member 900 may prevent the leakage of wash water, which may occur in the gap.

In addition, the sealing member 900 may allow the support body 410 to be spaced apart from the water guide 70 by a given distance. That is, when the support body 410 is spaced apart from the water guide 70 by a given distance, the position of the connection pipe 420 may be adjusted forward and rearward.

A pair of the protruding insertion portions 600 may be provided on opposite side surfaces of the support body 410. Each protruding insertion portion 600 may be inserted into a space between protrusions 700 to be described below, thereby allowing the supply unit 400 to be coupled to the water guide 70.

FIG. 3(*c*) illustrates that a connection member 500 is attached to the supply flow-path 71 provided with the supply port 72. The connection member 500 may be comprised of a coupling body 510 having one surface coupled to the supply flow-path 71 of the water guide 70 and the other surface coupled to the support body 410 of the supply unit 400, and a through-hole 520 formed in the coupling body 510 so that the supply port 72 is inserted into and penetrate the through-hole 520.

The coupling body 510 may be provided on opposite side surfaces thereof with fastening members 530, which may extend rearward so as to be fastened to the supply flow-path 71 of the water guide 70. Accordingly, the coupling body 510 may be separable from the water guide 70. In addition, the coupling body 510 may be provided with the protrusions 700, which protrude from the opposite side surfaces of the coupling body 510.

The protrusions 700 may have a polygonal bar shape. The multiple protrusions 700 may be spaced apart from one another by a constant distance along the opposite side surfaces of the coupling body 510.

The distance between the protrusions 700 may correspond to the thickness of the protruding insertion portion 600. That is, the distance between the protrusions 700 may provide an insertion space 800, into which the protruding insertion portion 600 may be inserted. Accordingly, as the protruding insertion portion 600 is inserted into the insertion space 800 between the protrusions 700, the supply unit 400 may be separably fastened to the water guide 70.

When the protruding insertion portion 600 is inserted into the insertion space 800, the upper and lower support surfaces of the protrusions 700 may support the protruding insertion portion 600 so as to support the supply unit 400. That is, as the connection member 500 is coupled to the water guide 70, the connection member 500 may serve as a medium that assists the supply unit 400 in being coupled to the water guide 70.

In addition, although the supply unit 400 may be considered as being coupled to the water guide 70, specifically, the supply unit 400 may be considered as being coupled to the connection member 500. However, because the object of the supply unit 400 is to receive wash water by being coupled to the water guide 70, it may be said that the supply unit 400 is coupled to the water guide 70. That is, the coupling of the supply unit 400 to the water guide 70 may have the same meaning as the coupling of the supply unit 400 to the connection member 500.

The protrusions 700 may provide the insertion space 800 for the insertion of the protruding insertion portion 600 therebetween so that the protruding insertion portion 600 is easily inserted into the insertion space 800 even if it is inserted in a vertically or horizontally tilted state. That is, the insertion space 800 may provide a wider space than an insertion hole having a width equal to or slightly greater than the width of the protruding insertion portion 600.

That is, the insertion space 800 between the protrusions 700 provides three surfaces, which may be engaged with and supported by the protruding insertion portion 600, but is open at opposite sides thereof, thus providing freedom by which the protruding insertion portion 600 may be inserted while freely changing the direction thereof. By allowing the protruding insertion portion 600 to be fitted into the insertion space 800 between the protrusions 700, rather than being inserted into an insertion hole, the accurate insertion of the protruding insertion portion 600 between the protrusions 700 may be implemented even if the protruding insertion portion 600 is inserted in a leftwardly or rightwardly deviated or tilted state, rather than being inserted at the correct position, at the initial state of insertion.

In addition, in the case where the water guide 70 is located on the inner rear surface of the tub 10, the user cannot view the connection member 500 attached to the water guide 70, and thus may have difficulty in fastening the supply unit 400 to the connection member 500. Even at this time, through the provision of the protrusions 700, it is sufficient for the user to approximate estimate the insertion space 800 between the protrusions 700. That is, the protruding insertion portion 600 may be naturally inserted into the insertion space 800 between the protrusions 700 even when merely approaching the insertion space 800, which may maximize convenience compared to the case where the protruding insertion portion 600 is inserted into an insertion hole.

Referring to FIG. 3(*c*), at least three pairs of protrusions 700 may be provided on the opposite side surfaces of the coupling body 510. As such, the protrusions 700 may provide at least two pairs of insertion spaces 800, into which the protruding insertion portion 600 may be inserted. That is, the protrusions 700 may provide the insertion spaces 800 for the insertion of the protruding insertion portion 600 at different heights.

In this way, the protruding insertion portion 600 may be inserted into the insertion space 800 at any of different heights, and consequently, the supply unit 400 may be fastened to the connection member 500 at any of different heights. In conclusion, the supply unit 400 may be coupled to the water guide 70 at any of different heights. Accordingly, the user can adjust the height of the supply unit 400 as needed in consideration of the size of dishes, washing load, and the like.

Meanwhile, the rack 80 of the dishwasher 1 may accommodate objects to be washed inside the tub 10, may be accommodated inside the tub 10, and may be pulled outward from the tub 10 (see FIG. 1). At this time, the upper rack 81 is generally tilted upward on the basis of the horizontal direction. This is because the user mainly tends to place a greater number of objects to be washed in a front region than in a rear region when placing the objects to be washed in the upper rack 81.

In other words, because the weight of the objects to be washed is generally concentrated in the front region of the upper rack 81, this serves to allow the upper rack 81 to be horizontally balanced without being tilted downward even when the weight of the objects to be washed is excessive.

In addition, even if the objects to be washed are evenly accommodated in the upper rack 81, the upper rack 81 is upwardly tilted in a no-load state, in order to prevent the upper rack 81 from being downwardly tilted.

The upper rack 81 may take the form of a basket having an open top side, which is formed as a combination of thin metal rods. As such, the wash water, sprayed from the spray arm 90, may be supplied to the objects to be washed, accommodated in the upper rack 81, without being blocked by the upper rack 81. Accordingly, as described above, the connection pipe 420 may be immovably integrated with the upper rack 81 as the hook 421 is fastened to the upper rack 81.

That is, when the user introduces or discharges the upper rack 81 into or out of the tub 10, the supply unit 400 is also introduced into or discharged out of the tub 10 to thereby be coupled to or separated from the water guide 70. At this time, because the angle by which the upper rack 81 is tilted may vary so that the upper rack 81 is moved from an upwardly lifted state to the horizontal direction, the gradient of the supply unit 400 may also vary so that the supply unit 400 is moved from an upwardly lifted state to the horizontal direction. Accordingly, the supply unit 400 needs to be easily fastened to the connection member 500 even if the gradient thereof varies.

FIG. 4 illustrates the protrusions 700, which have a rectangular shape and protrude from the side surface of the connection member 500.

When the protrusions 700 have a rectangular shape, the protruding insertion portion 600 may be inserted into and coupled to the insertion space 800 between the protrusions 700. However, referring to FIG. 4(*a*), when the upper rack 81 is introduced in an upwardly tilted state in the state in which the upper rack 81 and the supply unit 400 are coupled to each other as described above, the insertion of the protruding insertion portion 600 into the insertion space 800 between the protrusions 700 may be interrupted.

Even when the supply unit 400 is introduced alone in an upwardly tilted state in the state in which the supply unit 400 is not coupled to the upper rack 81, the insertion of the protruding insertion portion 600 into the insertion space 800 between the protrusions 700 may be interrupted.

In addition, when the protruding insertion portion 600 is not correctly inserted at the entrance of the insertion space 800, the protruding insertion portion 600 may be blocked by the protrusions 700. That is, the protruding insertion portion 600 may be inserted into the insertion space 800 between the protrusions 700 only when the protruding insertion portion 600 is within the range G1 between the protrusions 700. That is, it may be said that the maximum range in which the protruding insertion portion 600 may be inserted into the insertion space 800 may be the range G1.

Meanwhile, the excessive accuracy required to couple the supply unit 400 to the water guide 70 may cause significant user inconvenience. That is, because the protrusions 700 are located inside the tub 10, the user may experience inconvenience when coupling the supply unit 400 to the water guide 70.

FIG. 5 illustrates the protrusions 700 having slopes in order to solve the problem described above. Referring to FIG. 5(*a*), each protrusion 700 includes a first support surface 710, which extends forward from the side surface of the coupling body 510, a slope 730, which is forwardly inclined from the first support surface 710, and a second support surface 720, which extends rearward from the slope 730.

As such, even if the protruding insertion portion 600 is introduced, in an upwardly tilted state, between the protrusions 700, the slope 730 may guide the protruding insertion portion 600 so as to be inserted into the insertion space 800 between the protrusions 700. In addition, even if the protruding insertion portion 600 is not accurately introduced into the insertion space 800 between the protrusions 700, the slope 730 may guide the protruding insertion portion 600 so as to be inserted into the insertion space 800 between the protrusions 700. That is, even if the protruding insertion portion 600 is not accurately inserted into the insertion space 800 between the protrusions 700, the protruding insertion portion 600 may be accurately guided into the insertion space 800 along the slope 730 so long as the protruding insertion portion 600 comes into contact with the slope 730.

FIG. 5(*b*) illustrates the range G2 within which the protruding insertion portion 600 may be introduced into the insertion space 800 when the protruding insertion portion 600 is horizontally inserted between the protrusions 700. Referring to FIG. 5(*b*), the range G2 in which the protruding insertion portion 600 may be inserted when the slope 730 is provided is wider than the range G1 when the protrusion 700 includes no slope 730. Accordingly, because the radius at which the protruding insertion portion 600 may be inserted into the insertion space 800 is increased, user convenience may be increased. That is, user convenience may be increased by allowing the protruding insertion portion 600 to be smoothly guided into the insertion space 800 even through the user does not accurately align the protruding insertion portion 600 with the entrance of the insertion space 800 between the protrusions 700. In addition, in both the case where the protruding insertion portion 600 is introduced in an upwardly tilted state and the case where the protruding insertion portion 600 is introduced in the horizontal direction, the protruding insertion portion 600 may be smoothly guided into the insertion space 800, so long as the protruding insertion portion 600 comes into contact with the slope 730.

Although FIG. 5 illustrates that the length of the first support surface 710 is less than the length of the second support surface 720 so that the slope 730 is inclined upward, the length of the first support surface 710 may be greater than the length of the second support surface 720 so that the slope 730 is inclined downward.

In addition, the second support surface 720 of the protrusion 700 may extend so that the slope 730 protrudes forward from the coupling body 510. That is, a portion of the slope 730 may protrude forward from the coupling body 510. As such, the inclination angle of the slope 730 may be reduced, and the protruding insertion portion 600 may be more easily guided into the insertion space 800. In addition, the protruding slope 730 may allow the sealing member 900, provided between the coupling body 510 and the support body 410, to have any of various thicknesses. Accordingly, various sealing members 900 may be used.

FIG. 6 illustrates the slope 730 including upper and lower slopes. Referring to FIG. 6, the protrusion 700 may include the first support surface 710 extending forward from the side surface of the coupling body 510, a first slope 731 inclined forward from the first support surface 710, a second slope 732 inclined rearward from the end of the first slope 731, and the second support surface 720 horizontally extending rearward from the end of the second slope 732.

As such, the first slope 731 and the second slope 732 may guide the protruding insertion portion 600 so as to be smoothly inserted into the insertion space 800 even if the protruding insertion portion 600 is introduced in an upwardly or downwardly tilted state. That is, the first and second slopes 731 and 732 may guide the protruding insertion portion 600 so that the lower surface of the protruding insertion portion 600 is seated on the second support surface 720 of the protrusion 700.

FIG. 7 illustrates the protrusion 700 having a blocking surface. The slope 730 guides the insertion of the protruding insertion portion 600 into the insertion space 800. However, in the case where multiple insertion spaces 800 are provided at different heights, the slope 730 may guide the insertion of the protruding insertion portion 600 so that the protruding insertion portion 600 is distorted, or is inserted into the insertion space 800, which is at the height different from the protruding insertion portion 600. To prevent this problem, the protrusion 700 may have a blocking surface 740 at the front end thereof, the blocking surface 740 being parallel to the coupling body 510.

Referring to FIG. 7, when the protruding insertion portion 600 is inserted into an unintended insertion space 800, or is inserted at an excessive inclination angle, the blocking surface 740 may prevent the insertion of the protruding insertion portion 600. Accordingly, the blocking surface 740 may guide the user so as to accurately insert the supply unit 400 or the upper rack 81.

The protrusion 700 may include the first support surface 710 extending forward from the coupling body 510, the slope 730 inclined forward from the end of the first support surface 710, the blocking surface 740 extending from the end of the slope 730 so as to be parallel to the coupling body 510, and the second support surface 720 extending rearward from the end of the blocking surface 740.

The slope 730 and the blocking surface 740 may guide the user so as to insert the protruding insertion portion 600 into an intended insertion space 800.

Referring to FIGS. 3 to 8, the protrusion 700 may include a retaining surface 750, which connects the first support surface 710 and the second support surface 720 to each other.

Referring to FIG. 8, the protruding insertion portion 600 may have at least one raised retaining portion 610 on the upper surface or the lower surface thereof. As such, when the protruding insertion portion 600 is completely inserted into the insertion space 800, the raised retaining portion 610 may be seated at the rear of the retaining surface 750 so as to prevent the protruding insertion portion 600 from being separated from the insertion space 800. In addition, a retaining recess 751 may be formed in the lower end of the retaining surface 750 so that the raised retaining portion 610 may be engaged with the retaining recess 751. Accordingly, when the protruding insertion portion 600 is inserted into the insertion space 800, the raised retaining portion 610 may be engaged with and fixed to the retaining recess 751 of the retaining surface 750.

Meanwhile, although FIGS. 3 to 8 illustrate the retaining recess 751 formed in the lower end of the retaining surface 750, the case where the retaining recess 751 is formed in the first support surface 710 and the second support surface 720 so as to be engaged with the raised retaining portion 610 is not excluded. That is, so long as the raised retaining portion 610 is fixed to the retaining recess 751 so as not to be easily separated therefrom when the protruding insertion portion 600 is inserted into the insertion space 800, the retaining recess 751 and the raised retaining portion 610 may be located at any position.

Accordingly, through the cooperation of the retaining surface 750 or the retaining recess 751 and the raised retaining portion 610, it is possible to prevent the supply unit 400 from being separated from the connection member 500 against the user's intention. In addition, when the supply unit 400 is coupled to the rack 80, it is possible to prevent the supply unit 400 from being separated from the connection member 500 even if the weight of the objects to be washed in the rack 80 is great, which may increase stability. In addition, when the supply unit 400 receives wash water from the water guide 70, it is possible to prevent the supply unit 400 from being separated from the water guide 70 by the pressure of wash water discharged from the supply port 72. That is, the firm coupling of the supply unit 400 and the water guide 70 may prevent the leakage of wash water and maximize stability. In addition, the protruding insertion portion 600 may be provided with an insertion slope 620 having an inclined end.

Meanwhile, the insertion slope 620 may have a gradient corresponding to the gradient of the slope 730. In addition, the insertion slope 620 may be inclined so as to have a given curvature. Accordingly, when the protruding insertion portion 600 comes into contact with the second support surface 720 or the slope 730, the insertion slope 620 may allow the protruding insertion portion 600 to be smoothly inserted into the insertion space 800.

FIG. 9 illustrates the supply unit 400, which is introduced, in a leftwardly or rightwardly tilted state, into the connection member 500.

As described above, because the insertion space 800, which is defined between the protrusions 700 provided on the connection member 500, is open at opposite sides thereof, even if the protruding insertion portion 600 is first inserted into one side surface of the insertion space 800, the protruding insertion portion 600 may be fastened to the insertion space 800 at the opposite side.

Meanwhile, when the end of the protruding insertion portion 600 is defined by parallel flat surfaces, the end of the protruding insertion portion 600 may come into surface contact with the surface of the protrusion 700, which may prevent the smooth insertion of the protruding insertion portion 600. To improve this problem, as exemplarily illustrated in FIG. 9, the end of the protruding insertion portion 600 may have a side slope 630, which is inclined from the horizontal direction toward the center of the support body 510.

Accordingly, when the protruding insertion portion 600 approaches the connection member 500 leftward or rightward, the side slope 630 comes into contact with the side surface of the protrusion 700 so that the protruding insertion portion 600 continuously slides. That is, the protruding insertion portion 600 may be easily inserted into the connection member 500 even when it is inserted leftward or rightward.

Meanwhile, when the supply unit 400 is greatly deviated leftward or rightward upon insertion, or when the tilt angle of the supply unit 400 is excessive, the end of the side slope 630 of the protruding insertion portion 600 may come into contact with one surface of the protrusion 700, thus limiting the insertion of the protruding insertion portion 600 into the insertion space 800. That is, the horizontal radius at which the supply unit 400 is fastened to the water guide 700 may be small.

FIG. 10 illustrates the support body 410, which is wider than the coupling body 510, in order to solve the problem described above. Referring to FIG. 10, the width of the support body 410 is greater than the width of the coupling body 510, and the protruding insertion portion 600 protrudes from opposite side surfaces of the support body 410 and has a thickness that is increased toward the center of the support body 410.

Meanwhile, the distance between the protruding insertion portions 600, which protrude respectively from the opposite side surfaces of the support body 410, may correspond to the width of the coupling body 510. That is, the thickness of the protruding insertion portions 600 may be increased, and the coupling body 510 may correspond to the distance between the protruding insertion portions 600. That is, the side slope 630 of the protruding insertion portion 600 may be increased in width, and the side slope 630 may have a reduced gradient.

Accordingly, even when the supply unit 400 is inserted, in a leftwardly or rightwardly deviated state, into the coupling body 510, or when the supply unit 400 is inserted in a greatly leftwardly or rightwardly tilted state, one surface of the side slope 630 and one surface of the protrusion 700 may come into contact with each other. That is, the protruding insertion portion 600 may continuously slide on one surface of the protrusion 700, thereby being smoothly inserted into the insertion space 800.

FIG. 11 illustrates the support body 410 and the connection pipe 420 viewed from the front side. Referring to FIG. 11(*b*), the width of the support body 410 is greater than the width of the coupling body 510. At this time, even if the supply unit 400 may be smoothly inserted into the connection member 500 as the width of the support body 410 is increased, the strength of the supply body 410 may be reduced. In addition, because considerable pressure or vertical force may be applied to the protruding insertion portion 600 while the protruding insertion portion 600 is fastened to the connection member 500, a portion of the support body 410, from which the protruding insertion portion 600 protrudes, may need to be reinforced.

Accordingly, the support body 410 may be provided with a reinforcement rib 411, which protrudes in the left-to-right direction from one surface of the support body 410. A plurality of reinforcement ribs 411 may be spaced apart from one another by a constant distance in the height direction of the support body 410. In particular, the reinforcement ribs 411 may be collectively provided on the rear surface from which the protruding insertion portion 600 protrudes. In this way, the strength of the support body 410 may be increased so as to prevent damage to or bending of the support body 410.

Meanwhile, the protruding insertion portions 600 may protrude from the opposite side surfaces of the support body 410, and may be provided in a plural number so as to be spaced apart from one another in the height direction of the support body 410. Here, the distance between the protruding insertion portions 600, which are spaced apart from each other in the height direction, may be equal to the distance between the insertion spaces 800, which are spaced apart from each other on the coupling body 510, or may correspond to a multiple of the distance. That is, although the width B1 of the support body 41, illustrated in FIG. 11(*a*), is equal to the width A of the connection member 500 illustrated in FIG. 10(*b*), the width of the support body 410 illustrated in FIG. 11(*b*) is greater than the width A of the connection member 500. That is, the width B2 may be greater than the width B1. Accordingly, the multiple insertion portions 600 are inserted into the insertion spaces 800, which may maximize the force by which the supply unit 400 is inserted into the water guide 70 or the connection member 500.

FIGS. 12 to 15 illustrate the prevention of the leakage of wash water from between the water guide 70 and the connection member 500. Referring to FIG. 12, the water guide 70 includes the supply flow-path 71, which communicates with the sump 30, and the supply port 72, which is provided on one surface of the supply flow-path 71 for supplying wash water. Here, the supply port 72 is formed in the supply flow-path 71 and protrudes from one surface of the supply flow-path 71. That is, the supply port 72 may take the form of an oval or circular protruding track.

Meanwhile, the supply port 72 is formed of the same resin as the water guide 70. In addition, when the connection member 500 is formed of the same resin as the water guide 70, even if the connection member 500 is coupled to the water guide 70, the wash water discharged from the supply port 72 may leak from between the connection member 500 and the supply flow-path 71.

Here, when the leakage of wash water occurs between the connection member 500 and the supply flow-path 71, an amount of wash water corresponding to the quantity of wash water that leaks may not be transferred to the supply unit 400, which may reduce the pressure and flow rate of wash water supplied to the spray arm 90, and consequently, deteriorate washing efficiency.

Referring to FIG. 13, a second sealing member 910 may be provided between the connection member 500 and the supply flow-path 71. That is, the second sealing member 910 may be provided between the connection member 500 and the supply flow-path 71 for preventing the leakage of wash water. That is, the second sealing member 910 may surround the outer circumference of the supply port 72 and may also surround the outer circumference of the through-hole 520 in the connection member 500, thereby preventing the leakage of wash water.

Here, the second sealing member 910 may be thinner than the sealing member 900 provided between the support body 410 and the water guide 70, and may be configured as an elastic member. However, when the second sealing member 910 is separately provided, manufacturing costs increase and the gap between the coupling body 510 and the supply flow-path 71 unnecessarily increases.

FIG. 14 illustrates a sealing unit 540 coupled to the coupling body 510. Referring to FIG. 14, the sealing unit 540 may include a sealing body 541 provided on the inner circumference of the through-hole 520 in the coupling body 510 and an introduction port 542 formed in the sealing body 541, the introduction port 542 having a smaller diameter than the through-hole 520. The thickness of the introduction port 542 may be less than the thickness of the sealing body 541.

Here, the sealing unit 540 may be configured as an elastic member, and may be integrally coupled with the coupling body 510. In addition, the sealing unit 540 may be integrally formed with the coupling body 510 via injection molding. That is, the sealing unit 540, which is configured as an elastic member, may be injection molded simultaneously with the plastic injection molding of the coupling body 510. That is, the sealing unit 540 may be integrally formed with the coupling body 510. In addition, the diameter of the introduction port 542 may be less than the diameter of the supply port 72.

Referring to FIG. 15, when the connection member 500 is fastened to the water guide 70, the supply port 72 is introduced into the introduction port 542 so as to penetrate the same so that the introduction port 542 having a small thickness comes into contact with the outer circumference of the supply port 72, thereby preventing the leakage of wash water from the supply port 72. That is, it is possible to completely prevent the wash water, discharged from the supply port 72, from leaking from between the coupling body 510 and the supply flow-path 71. In this way, the pressure and flow rate of wash water supplied to the supply unit 400 may be maintained, resulting in increased washing efficiency.

The sealing unit 540 may include a sloped portion 543 on the outer circumference of the introduction port 542 in order to guide the introduction of the supply port 72 into the introduction port 542. That is, because the sealing body 541 is thicker than the introduction port 542, the thickness of the sloped portion 543 may be gradually reduced. In addition, the thickness of the introduction portion 542 may be small so as to enable smooth contact with the outer circumference of the supply port 72. That is, the thickness of the introduction port 542 may be less than the thickness of any portion of the sloped portion 543, and the introduction port 542 may have a constant thickness. Accordingly, when the connection member 500 is coupled to the water guide 70, the end of the supply port 72 may be guided to the introduction port 542 along the sloped portion 543. Thereafter, the supply port 72 having passed through the introduction port 542 protrudes from the other surface of the coupling body 510. At this time, the introduction port 542 prevents the leakage of wash water by surrounding the outer circumference of the supply port 72.

Hereinafter, a supply unit 400*a* and a connection member 500*a* according to another embodiment of the present invention will be described in detail with reference to the accompanying drawings. Here, in the description of another embodiment of the present invention, a detailed description of the same parts as those of the above-described embodiment will be omitted.

FIG. 16 illustrates the supply unit and the water guide according to another embodiment of the present invention in an enlarged scale.

Referring to FIG. 16, the supply unit 400*a* may serve to connect the spray arm 91 and the water guide 70 to each other, and may be separably coupled to the water guide 70. The supply unit 400*a* is provided with a sealing member 900*a*, which connects the connection pipe 420 and the water guide 70 to each other, and a support body 410*a*, which connects the sealing member 900*a* and the spray arm 91 to each other. The water guide 70 is provided with a connection member 500*a*, to which the supply unit 400*a* may be compressed and coupled.

The sealing member 900*a* may be formed of a flexible material so as to be flexible in the longitudinal direction thereof, and may have any shape or may be formed of any material so long as it can constrict and stretch. According to the embodiment of the present invention, the sealing member 900*a* has a bellows shape to achieve flexibility, without being limited thereto.

As illustrated in FIG. 17, the sealing member 900*a* according to the embodiment of the present invention has a bellows shape such that a maximum area cross section and a minimum area cross section are alternately mixed with each other. The bellows-shaped sealing member 900*a* may be flexible.

Meanwhile, the sealing member 900*a* may be comprised of a first cross section A, which corresponds to the maximum area cross section, and a second cross section B, which corresponds to the minimum area cross section. In addition, the first cross section A and the second cross section B may be alternately mixed with each other so as to define a bellows.

Meanwhile, the end of the sealing member 900*a*, which corresponds to the second cross section B, comes into contact with the connection member 500*a*. This is because, when the sealing member 900*a* is compressed and coupled to the connection member 500*a*, providing the sealing member 900*a*, which is in contact with the connection member 500*a*, with the maximum area cross section reduces the risk of leakage of wash water, compared to the provision of the minimum area cross section.

The support body 410*a* serves to connect the sealing member 900*a* and the spray arm 91 to each other. In addition, the edge of the support body 410*a* is provided with a connector 600*a* to enable the coupling of the support body 410*a* and the connection member 500*a*, and is also provided with an extension 604, which may limit the distance by which the sealing member 900*a* may be compressed.

The connection member 500*a* is an element that is provided on the water guide 70 and is coupled to the sealing member 900*a*. The connection member 500*a* is comprised of a body 530*a* coupled to the water guide 70, a stopper 524*a* provided on the body 530*a* to limit the distance by which the sealing member 900*a* may be compressed, a wash water supply opening 520 provided in the body 530*a* to supply wash water from the water guide 70 to the spray arm 91, a guide 522*a* provided on the body 530*a* to assist the wash water supply opening 520 in being positioned inside the sealing member 900*a* when the sealing member 900*a* is compressed, and a gasket surface 510*a* to prevent the leakage of wash water when the sealing member 900*a* is compressed and coupled to the connection member 500*a*.

The cross-sectional area of the sealing member 900*a* is greater than the cross-sectional area of the wash water supply opening 520. That is, the cross section of the sealing member 900*a* has a larger height and width than the height and width of the cross section of the wash water supply opening 520. In addition, the cross section of the sealing member 900*a* and the cross section of the wash water supply opening 520 may have a circular shape. In this case, the diameter of the sealing member 900*a* is greater than the diameter of the wash water supply opening 520. In addition, when the sealing member 900*a* is compressed and coupled to the connection member 500*a*, the position at which the sealing member 900*a* is installed may be freely changed so long as the wash water supply opening 520 is located inside the cross section of the sealing member 900*a*.

That is, the position at which the sealing member 900*a* and the connection member 500*a* are coupled to each other may be vertically changed as the supply unit 400*a* is vertically moved. Specifically, the position may be adjusted within a range acquired by subtracting the height of the wash water supply opening 520, multiplied by two, from the height of the sealing member 900*a*.

The width of the gasket surface 510*a* may be greater than the width of the cross section of the sealing member 900*a*. In particular, the height of the gasket surface 510*a*, which serves to prevent the leakage of wash water, may be increased by the range within which the height of the sealing member 900*a* may be adjusted.

When the sealing member 900*a* is compressed and coupled to the connection member 500*a*, the stopper 524*a* may prevent the sealing member 900*a* from being compressed beyond a given length. As the compression of the sealing member 900*a* is gradually progressed, the stopper 524*a* is brought into contact with the extension 604.

The interaction of the stopper 524*a* and the extension 604 may prevent the sealing member 900*a* from being excessively compressed, and may prevent the risk of deformation of the sealing member 900*a*.

The stopper 524*a* may be provided along the edge of the body 530*a* so as not to interfere with the sealing member 900*a* when the sealing member 900*a* is compressed and coupled to the connection member 500*a*.

In addition, in order to prevent the excessive compression of the sealing member 900*a*, the stopper 524*a* protrudes from the body 530*a* toward the sealing member 900*a* by a prescribed distance.

In addition, a plurality of stoppers 524*a* may be provided, and the positions at which the stoppers 524*a* are installed may be freely changed so long as they can prevent the excessive compression of the sealing member 900*a*. The excessive compression of the sealing member 900*a* may be more effectively prevented when the stoppers 524*a* are symmetrically arranged on the left and right sides of the body 530*a*.

The guide 522*a* serves to guide the wash water supply opening 520 so as to be located inside the sealing member 900*a* when the sealing member 900*a* is compressed. The guide 522*a* is fastened to the connector 600*a* when the sealing member 900*a* is compressed and coupled to the connection member 500*a*. In order to adjust the height of the sealing member 900*a*, a plurality of connectors 600*a* may be provided on the support body 410*a*.

The guide 522*a* may be provided along the edge of the body 530*a* so as to avoid interference with the sealing member 900*a*. In addition, the connector 600*a*, which is coupled to the guide 522*a*, may also be provided along the edge of the support body 410*a*.

The guide 522*a* may protrude from the body 530*a* by a prescribed distance, and may protrude further than the stopper 524*a*. In addition, a plurality of guides 522*a* may be provided on the body 530*a*, and the guides 522*a* may be symmetrically arranged on the same height at the left and right sides of the body 530*a* in order to enable the balanced coupling of the supply unit 400*a* and the connection member 500*a*.

Meanwhile, as illustrated in FIG. 16, the connector 600*a* is comprised of a first connector 601 protruding from the support body 410*a*, a second connector 602 spaced apart from the first connector 601 by a prescribed distance, and a third connector 603 spaced apart from the second connector 602 by a prescribed distance.

The second connector 602 may be located between the first connector 601 and the third connector 603, and the first connector 601 may be located at the uppermost position. The guide 522*a* may be coupled to any one of the first connector 601, the second connector 602, and the third connector 603, and the height of the supply unit 400*a* may be changed depending on each connector 601, 602 or 603.

FIGS. 17 and 18 are views illustrating the states before and after the guide 522*a* is connected to the second connector 602. The sealing member 900*a* is compressed and coupled to the gasket surface 510*a* of the connection member 500*a*, and the distance by which the sealing member 900*a* may be compressed may be limited by the contact between the stopper 524*a* and the extension 604. In addition, the sealing member 900*a* and the connection member 500*a* may be coupled to each other within a range within which the wash water supply opening 520 is located inside the sealing member 900*a*.

FIGS. 19 and 20 are views illustrating the states before and after the guide 522*a* is connected to the third connector 603. It can be appreciated that the supply unit 400*a* is moved further upward compared to the case where the guide 522*a* is connected to the second connector 602. Even in this case, the distance by which the sealing member 900*a* may be compressed may be limited by the contact between the stopper 524*a* and the extension 604. In addition, the sealing member 900*a*, and the connection member 500*a* may be coupled to each other within a range within which the wash water supply opening 520 is located inside the sealing member 900*a*.

Likewise, although not illustrated in the drawings, in order to locate the supply unit 400*a* at a lower position than when the guide 522*a* is connected to the second connector 602, the guide 522*a* may be coupled to the first connector 601. Even in this case, the distance by which the sealing member 900*a* may be compressed may be limited by the contact between the stopper 524*a* and the extension 604. In addition, the sealing member 900*a*, and the connection member 500*a* may be coupled to each other within a range within which the wash water supply opening 520 is located inside the sealing member 900*a*.

In this way, the height of the supply unit 400*a* may be adjusted by coupling the guide 522*a* to any one of the first connector 601, the second connector 602, and the third connector 603, and the guide 522*a* or the stopper 524*a* may be disposed on the extension 604, which is formed on each of the first connector 601, the second connector 602, and the third connector 603, so as to adjust the degree by which the sealing member 900*a* is compressed.

Although the exemplary embodiments have been illustrated and described as above, of course, it will be apparent to those skilled in the art that the embodiments are provided to assist understanding of the present invention and the present invention is not limited to the above described particular embodiments, and various modifications and variations can be made in the present invention without departing from the spirit or scope of the present invention, and the modifications and variations should not be understood individually from the viewpoint or scope of the present invention.

MODE FOR THE INVENTION

As described above, a related description has sufficiently been discussed in the above "Best Mode" for implementation of the present invention.

INDUSTRIAL APPLICABILITY

As described above, the present invention may be wholly or partially applied to a dishwasher.

The invention claimed is:

1. A dishwasher comprising:

a tub providing a washing space;

a door provided on a front of the tub for opening or closing the washing space;

a sump provided under the tub for storing wash water;

a rack provided so as to be pulled from the tub for accommodating an object to be washed;

a spray arm for spraying wash water to the object to be washed;

a water guide including a supply flow-path for communicating with the sump, the supply flow-path being provided inside the tub for providing a flow-path for movement of the wash water from an inside of the sump, and a supply port formed in one surface of the supply flow-path for supplying the wash water;

a supply unit including a support body provided with a communication hole for communicating with the supply port in order to receive the wash water, a connection pipe extending from the support body for transferring the wash water to the spray arm, and an spray arm coupler provided on an end of the connection pipe so as to be coupled to the spray arm; and a connection member including a coupling body having one surface coupled to the water guide and a remaining surface coupled to the support body, and a through-hole formed in the coupling body so as to communicate with the supply port, wherein the supply unit further includes at least one insertion portion protruding rearward from opposite side surfaces of the support body, and wherein the connection member includes a plurality of protrusions protruding from opposite side surfaces of the coupling body so that the supply unit is coupled to the water guide as the protruding insertion portion is inserted between the protrusions and a sealing unit provided on an inner circumference of the through-hole in the coupling body for preventing leakage of wash water from between the coupling body and the water guide.

2. The dishwasher according to claim 1, wherein the protrusions include at least three pairs of protrusions provided along the opposite side surfaces of the coupling body so as to define at least two pairs of insertion spaces, and wherein the supply unit is coupled to the water guide at any of different heights as the protruding insertion portion is inserted into and coupled to one of the insertion spaces.

3. The dishwasher according to claim 2, wherein each of the protrusions includes a forwardly extending first support surface, a slope inclined forward from an end of the first support surface, and a second support surface extending rearward from an end of the slope, and wherein the slope guides the protruding insertion portion so as to be inserted into one of the insertion spaces even if the protruding insertion portion is inserted, in an upwardly or downwardly tilted state, into the insertion space.

4. The dishwasher according to claim 3, wherein the first support surface has a length shorter than a length of the second support surface so that the slope is inclined upward.

5. The dishwasher according to claim 3, wherein the first support surface has a length longer than a length of the second support surface so that the slope is inclined downward.

6. The dishwasher according to claim 3, wherein the protrusion includes a retaining surface connecting the first support surface and the second support surface to each other, wherein the protruding insertion portion includes a raised retaining portion on an upper surface and/or a lower surface thereof, and wherein the raised retaining portion is fixed to the retaining surface when the protruding insertion portion is completely inserted into the insertion space.

7. The dishwasher according to claim 2, wherein each of the protrusions includes a forwardly extending first support surface, a slope inclined forward from an end of the first support surface, a blocking surface extending from an end of the slope so as to be parallel to one surface of the coupling body, and a second support surface extending rearward from an end of the blocking surface, and wherein the blocking surface prevents the protruding insertion portion from being inserted into the insertion space when the protruding insertion portion is inserted to an incorrect position.

8. The dishwasher according to claim 2, wherein each of the protrusions includes a forwardly extending first support surface, a first slope inclined forward from an end of the first support surface, a second slope inclined rearward from an end of the first slope, and a second support surface extending rearward from the second slope, and wherein the first slope and the second slope guide the protrusion insertion portion so as to be inserted into one of the insertion spaces when the protruding insertion portion is inserted in an upwardly or downwardly tilted state.

9. The dishwasher according to claim 2, wherein the protruding insertion portion is provided in a plural number so as to be inserted into at least two insertion spaces among the insertion spaces.

10. The dishwasher according to claim 2, wherein the protruding insertion portion includes an insertion slope provided on an end thereof so as to be inclined relative to a height direction.

11. The dishwasher according to claim 2, wherein the protruding insertion portion includes a side slope provided on an end thereof so as to be inclined toward a center of the support body so that the protruding insertion portion is guided into the insertion space even if the support body is inserted, in a leftwardly or rightwardly tilted state, into the coupling body.

12. The dishwasher according to claim 11, wherein the support body has a width greater than a width of the coupling body, and wherein the at least one protruding insertion portion includes a pair of protruding insertion portions provided on the opposite side surfaces of the support body, and a distance between the protruding insertion portions is equal to the width of the coupling body.

13. The dishwasher according to claim 12, wherein the support body includes a plurality of protruding reinforcement ribs on one surface thereof, provided with the connection pipe, so as to extend in a left-to-right direction, and wherein the reinforcement ribs are spaced apart from each other by a constant distance in a height direction of the support body.

14. The dishwasher according to claim 13, wherein the reinforcement ribs are provided on a portion of the surface of the support body that corresponds to a location of the protruding insertion portion.

15. The dishwasher according to claim 2, further comprising a sealing member for sealing a gap between the support body and the coupling body, wherein the protruding insertion portion on the support body has a length greater than a thickness of the sealing member.

16. The dishwasher according to claim 15, wherein the sealing member has a height and width greater than a height and a width of the supply port.

17. The dishwasher according to claim 15, wherein the sealing member is flexible in a movement direction of the supply unit.

18. The dishwasher according to claim 15, further comprising:

a guide provided on the connection member for assisting a wash water supply opening in being positioned inside the sealing member when the sealing member is compressed; and a connector provided on the support body and connected to the guide when the sealing member is compressed.

19. The dishwasher according to claim 18, wherein the connector includes:

a first connector protruding from the support body;

a second connector protruding from the support body and spaced apart from the first connector by a prescribed distance; and a third connector protruding from the support body and spaced apart from the second connector by a prescribed distance, and wherein the guide is coupled to one of the first connector, the second connector, and the third connector.

20. The dishwasher according to claim 18, further comprising:

a body defining a main body of the connection member;

a stopper provided on the body for limiting a compressible distance of the sealing member; and an extension provided on the support body so as to come into contact with the stopper when the sealing member is compressed.

21. The dishwasher according to claim 20, wherein the stopper protrudes from the body toward the sealing member.

22. The dishwasher according to claim 20, wherein the stopper is provided in a plural number on the body, and wherein the plurality of stoppers is symmetrically provided on left and right sides of the body.

23. The dishwasher according to claim 2, further comprising a second sealing member provided between the coupling body and the water guide so as to come into contact with an outer circumference of the through-hole in the coupling body and an outer circumference of the supply port, thereby preventing leakage of wash water from between the coupling body and the water guide.

24. The dishwasher according to claim 1, wherein the supply port protrudes from one surface of the supply flowpath, wherein the sealing unit includes a sealing body provided on the inner circumference of the through-hole, and an introduction port provided on an inner circumference of the sealing body and having a diameter smaller than a diameter of the supply port, wherein the sealing body and the introduction port are formed as an elastic member, and wherein the introduction port has a shape corresponding to a shape of the supply port so that an inner circumference of the introduction port comes into close contact with an outer circumference of the supply port when the supply port is inserted into the introduction port, thereby preventing leakage of wash water from between the supply port and the coupling body.

25. The dishwasher according to claim 20, wherein the introduction port has a thickness smaller than a thickness of the sealing body.

26. The dishwasher according to claim 24, wherein the sealing body has the same thickness as the coupling body, and includes a sloped portion, a thickness of which is gradually reduced from a center of the sealing body to the introduction port, so as to guide the supply port to be inserted into the introduction port.

27. The dishwasher according to claim 1, wherein the sealing unit is integrally formed with the coupling body via injection molding.

28. The dishwasher according to claim 1, wherein the protrusions are spaced apart from each other by a distance that is equal to a thickness of the protruding insertion portion so as to define at least two insertion spaces for insertion of the protruding insertion portion, and the protruding insertion portion is inserted into one of the insertion spaces.

* * * * *